US005511257A

United States Patent [19]

Hannes

[11] Patent Number: 5,511,257

[45] Date of Patent: Apr. 30, 1996

[54] COUNTERBALANCED GATE FOR A HOSPITAL YOUTH CRIB AND METHOD FOR USING THE SAME

[75] Inventor: Joseph W. Hannes, Franklin, Wis.

[73] Assignee: The Brewer Company, Menomonee Falls, Wis.

[21] Appl. No.: 293,532

[22] Filed: Aug. 19, 1994

[51] Int. Cl.[6] ..... A47D 7/02

[52] U.S. Cl. ..... 5/100; 5/425; 49/445; 49/449; 292/33

[58] Field of Search ..... 5/100, 93.1, 428, 5/425; 49/449, 450, 445, 446; 292/33, 42

[56] References Cited

U.S. PATENT DOCUMENTS

| | | | |
|---|---|---|---|
| 275,070 | 4/1983 | Opdyke . | |
| 685,448 | 10/1901 | Jacobs | 5/425 |
| 1,179,685 | 4/1916 | Vallone | 5/100 |
| 2,979,738 | 4/1961 | Goldberg | 5/100 |
| 3,541,619 | 4/1970 | Morrison . | |
| 3,590,403 | 7/1971 | Mixon | 5/100 |
| 3,649,973 | 3/1972 | Benoit et al. | 5/100 |
| 3,921,233 | 4/1975 | Mann | 5/100 |
| 3,934,496 | 1/1976 | Turko | 49/445 |
| 4,091,439 | 5/1978 | Blair, Jr. | 49/445 |
| 4,752,977 | 6/1988 | Smith et al. | 5/100 |
| 4,768,243 | 9/1988 | Waples | 5/100 |
| 4,935,987 | 6/1990 | Sterner, Jr. | 49/446 |
| 4,998,939 | 3/1991 | Potthast et al. | 5/428 |
| 5,050,943 | 9/1991 | Barnett | 49/445 |
| 5,072,464 | 12/1991 | Draheim et al. | 5/100 |

*Primary Examiner*—Alexander Grosz
*Attorney, Agent, or Firm*—Wheeler & Kromholz

[57] ABSTRACT

An essentially weightless hospital youth crib side gate having a latch mechanism requiring a compound sequential motion for release. A pair of spring powered reels are attached at opposite ends of the lower horizontal frame member of a side gate of a hospital youth crib and the spring powered wire cables are attached to the side gate crib track which is mounted to the crib frame. The spring powered reels counterbalance the weight of the side gate producing an essentially "weightless" side gate. The gate further includes a latch release mechanism whereby a push button must first be fully depressed before a pair of latch handles can be brought together to fully release the latch rods which hold the side gate in a predetermined position. Only after both motions have been sequentially performed can the side gate be raised or lowered. Operating the latch requires only a single adult hand and is very difficult to be operated by a child, even if the child were to use both hands.

3 Claims, 4 Drawing Sheets

COUNTERBALANCED GATE FOR A HOSPITAL YOUTH CRIB AND METHOD FOR USING THE SAME

BACKGROUND OF THE INVENTION

Hospital youth cribs or pediatric cribs are well known in the art. Each consists of four (4) vertical end frame members. The members are connected in a rectangular arrangement. A head frame or a foot frame is formed by each pair of vertical end frame members. A plurality of vertical rungs extend between upper and lower horizontal frame members. A pair of gatches is attached to each frame and runs to the opposite frame forming the crib sides. A side gate having a frame and a plurality of similar vertical rungs is positioned between each frame just outside each gatch. A crib floor, parallel to the ground, is supported by each frame member. Typically, wheels are attached to the base of each vertical member to provide mobility of the hospital youth crib.

In order to easily gain access to the interior of the crib, at least one of the side gates is moveable. A pair of tracks is attached to an adjacent pair of vertical frame members and the sides of the gate frame are positioned within the pair of tracks. The moveable side gate can then be lowered below the crib floor to allow for easy ingress and egress of a child patient. Furthermore, a lowered side gate provides medical personnel with easy access to the child patient. A side gate for a hospital youth crib weighs approximately 18 pounds. Due to this weight, it is often burdensome for medical personnel to lift the crib side gate into its closed position, especially when trying to keep a young patient from attempting to get out of the crib before the side gate is fully raised. Such attempts by children often require the nurse or medical personnel to keep one hand on the child restraining his or her movements. This leaves only one hand free to raise the crib side gate. Even if the child does not need to be restrained, one hand may be required to keep tubing, electrical wires, and other medical equipment from being caught in the crib side gate track while raising the crib side gate. Again, only one hand is free to raise the side gate. When opening or lowering the side gate, if the nurse is unaware of its weight or loses his or her grip, the side gate may drop too quickly and abruptly bottom out at the end of the track.

In the above noted situations, as well as many others, a "weightless" side gate has many advantages. The operator of the gate is not easily thrown off balance by the weight of the gate increasing his or her chances of falling onto the crib, accidentally removing medical apparatus, or otherwise endangering the safety of the child patient. Furthermore undue stress or strain is not imparted on the operator's back when attempting to lift the heavy gate. If the operator were to loose his or her grip while closing the side gate, the gate of this invention will not fall to the bottom of the track stopping abruptly at the track end.

Because the side gate is moveable and can be raised and lowered with minimal effort, the "weightless" side gate of this invention is provided with a latch mechanism that cannot operated by a child but, in light of the foregoing provisions for single hand operation, can be easily activated by an adult using only one hand. The latch requires a sequential compound hand motion to disengage the latching means so that the gate can be raised or lowered.

One of the objects of the present invention is to provide a hospital youth crib with a "weightless" gate that can be raised and lowered for ingress and egress of a child patient.

Another object of the present invention is to provide a novel way of attaching a pair of spring powered reels to at least one side gate of a hospital youth crib so that the side gate becomes essentially weightless. Another object is to provide the hospital youth crib with a novel side gate latch mechanism requiring a single hand sequential compound motion on the part of an adult in order to release the gate from its locked position. By design, the latch mechanism cannot be operated by a child even if the child uses both hands. These and other objects of the invention will become apparent in the descriptions herein.

SUMMARY OF THE INVENTION

The invention comprises an essentially weightless side gate for a hospital youth crib. The gate further includes a release mechanism which is operable with a single hand but requires a compound sequential hand motion for release.

Hospital youth cribs or pediatric cribs are well known in the art. Each consists of four (4) vertical end frame members. The members are connected in a rectangular arrangement. A head frame or a foot frame is formed by each pair of vertical end frame members. A plurality of vertical rungs extend between upper and lower horizontal frame members. A pair of gatches is attached to each frame and runs to the opposite frame forming the crib sides. A side gate having a frame and a plurality of similar vertical rungs is positioned between each frame just outside each gatch. A crib floor, parallel to the ground, is supported by each frame member. Typically, wheels are attached to the base of each vertical member to provide mobility of the hospital youth crib. To at least one gate of a hospital youth crib, a pair of spring powered reels is attached to provide an essentially weightless gate. The pair of spring powered reels having spring powered cables are attached to the underside of the side gate frame, one at each lower end of the gate. The spring powered wire cable exits each spring powered reel in the plane horizontal to the floor, wraps around a cable guide within the spring powered reel housing and turns approximately 90 degrees upward as it enters the vertical member that forms one of the end frames of the side gate. The end of the wire cable exits the side gate frame vertical member through an elongated slot and is fixedly attached at a midpoint to the adjacent end frame member within the gate track attached to the end frame. As the side gate is raised and lowered, the wire cable is extracted from and retracted into the spring powered reel. In the fully raised position, a minimum of amount of wire cable is extracted from the reel. When the side gate is lowered to its lower most position, the maximum amount of wire cable is extracted.

A helical torsion spring having a constant spring rate has one end connected to the spool of the spring powered reel. The other end is attached to the spring powered reel outer housing. As the side gate is raised and lowered, the helical torsion spring exerts a constant force upon the spool which in turn exerts a constant force upon the wire cable which is wrapped around the spool. The spring force equals the force of gravity as calculated by the weight of the side gate. Because the free end of the wire cable is attached to the end frame of the crib, the spring's constant force counteracts the force of gravity imparted upon the side gate and provides a "weightless" side gate.

A push button latch assembly for releasing the side gate from its fully raised or fully lowered position and securing it to a new position is provided on each movable side gate. The latch assembly is designed to be operated by an adult using only one hand while being very difficult to be operated by a child. The latch mechanism requires a compound or two-step process before the side gate is released from its location. The process must be followed sequentially and both steps must be fully performed before the side gate is released and can be moved. The side gate of a hospital youth crib fits within a pair of tracks attached to adjacent vertical end frame members and is held in the desired horizontal location by a pair of latch rods which are located within the top horizontal tubular member of the side gate. Each rod protrudes at the ends of the gate and fits into an aperture provided within the track attached to the end frame members. When the pair of latch bars have been retracted from their apertures, the side gate slides up and down within the track. When the latch bars re-enter apertures, the side gate is locked into a horizontal position.

The side gate latch mechanism comprises a spring loaded button and a pair of handles. First the button is depressed. When depressed or pressed inward toward the wall of the side gate horizontal top tubular member, a release button connected to the back side of the push button also moves inward. Once fully depressed, the release button unlocks the two handles which can now be brought together. One latch rod is connected to each handle such that when each handle is moved toward the centerline of the latch assembly, the corresponding latch rod is withdrawn from the aperture in the track of the end frame. Once completely withdrawn, the side gate can be raised or lowered to the desired position. When the gate has been moved within the proximity of the desired position, the handles are released. The latch rods, which are also spring loaded or biased in an outward direction, enter apertures in the tracks. Once each latch rod has entered an aperture, the side gate is securely locked into the selected position.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
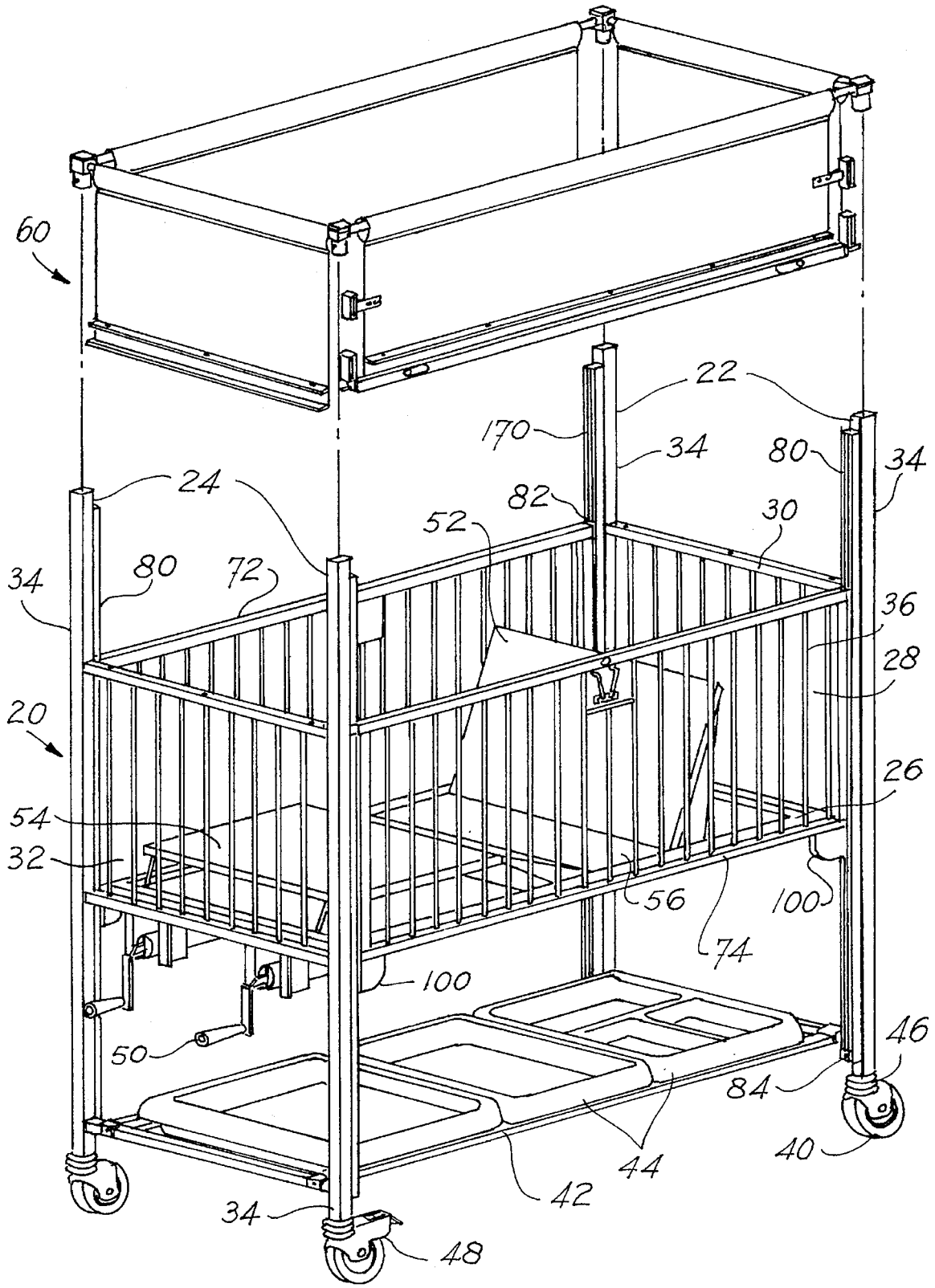
FIG. 1 is a perspective view of a hospital youth crib having an upper curtain and including my weightless side gate and release mechanism.

As shown in FIG. 1, a typical hospital youth crib or pediatric crib 20 includes a head end frame 22, a foot end frame 24, a pair of gatches 26, a pair of side gates 28, a head gate 30 and foot gate 32. A plurality of vertical rungs 36 extend between upper and lower horizontal frame members forming the crib enclosure for the child patient. Casters 40 are inserted into the ends of the vertical frame members 34 of head end frame 22 and foot end frame 24 for easy mobility of the crib 20. An accessory tray support 42 having accessories trays 44 is often provided for the storage of medical equipment, supplies, and the patient's belongings.

As further shown in FIG. 1, a pair of crank handles 50 is provided on the foot end frame 24 for raising and lowering the back rest 52 and leg rest 54 of the crib floor 56. Both rests 52 and 54 are shown in their elevated positions in FIG. 1. Shown above crib 20 is a curtain assembly 60. The optional curtain assembly 60 is used to prevent the older child patient from climbing up and over the side gates 28, head gate 30, or foot gate 32 even though each gate has been raised to its highest position.

Figure 2:
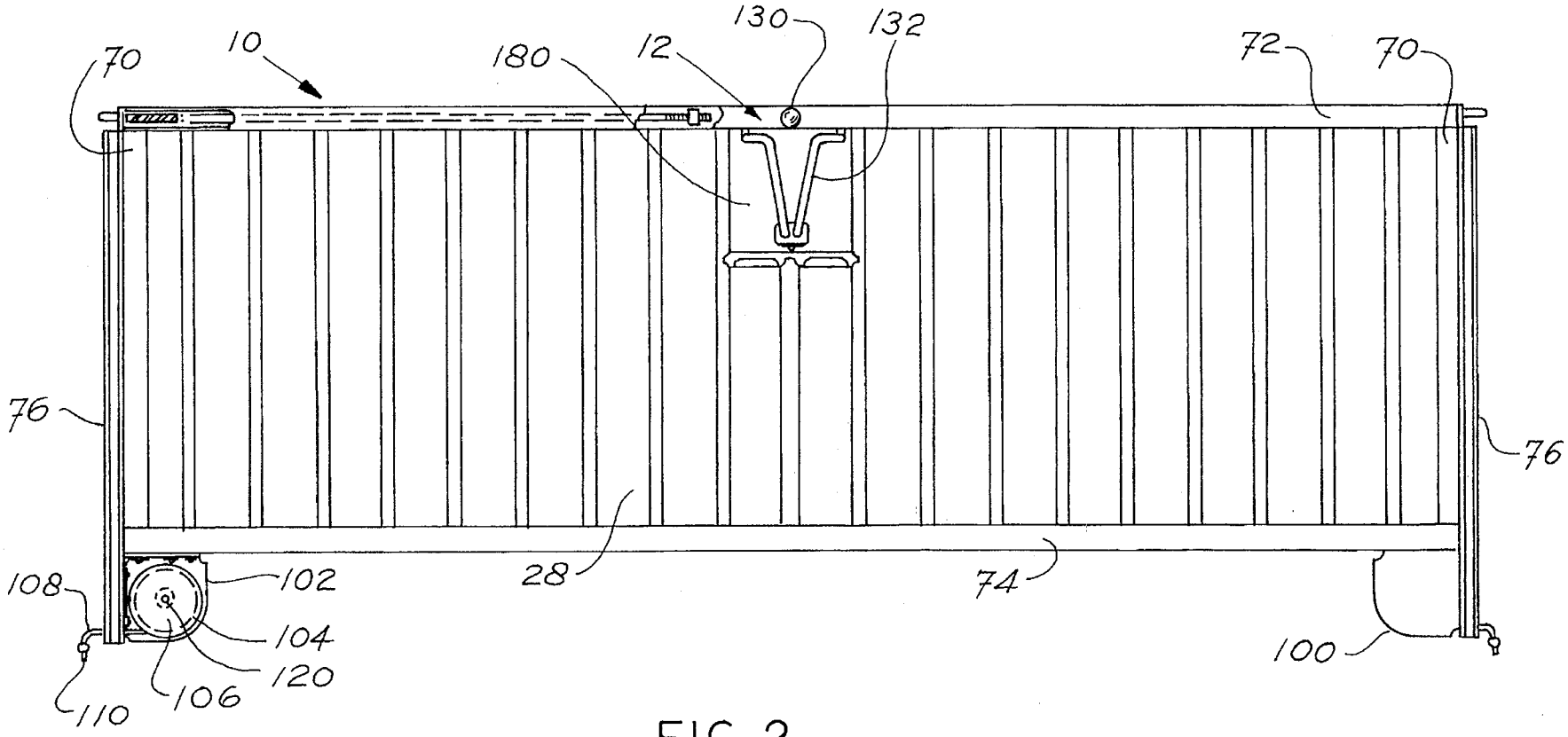
FIG. 2 is a front view of my weightless hospital youth crib side gate and release mechanism.
Figure 3:
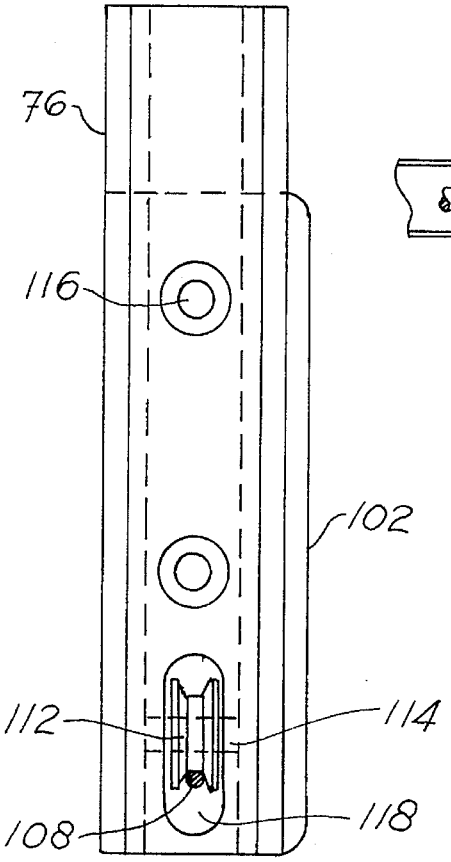
FIG. 3 is a side view of the spring powered reel attached to a hospital youth crib side gate.

My hospital youth crib 20 weightless gate 10 is best shown in FIG. 2. My latch mechanism 12 is also shown in FIG. 2. At least one spring powered reel 100 is attached to lower horizontal tubular frame member 74 which forms the bottom of side gate 10 and to vertical track member 76 which extends below horizontal frame member 74. While rivets 116 are preferred, any attachment means could be used for securing reel housing 102 to members 74 and 76.

Side gate 10 moves up and down in a pair of receiving tracks 80. One track 80 is attached to the head end frame 22 and the other to the foot end frame 24. Side gate 10 has a closed or upper most position where its upper horizontal member 72 rests against upper stop 82 located within receiving track 80. When side gate 10 is raised to this position, it is difficult to gain access to the child patient. Therefore side gate 10 can be lowered on tracks 80 to a lower most position. In this lowered position, upper horizontal frame member 72 is almost as low as gatch 26 providing easy access to the child patient.

Each spring powered reel 100 that serves as a counterbalance device to produce the "weightless" gate 10 is commercially manufactured. The preferred reel 100 is an Ametek-Hunter powered reel Model ML-1851, however any similar spring powered reel 100 would function properly. The reel 100 has a housing 102, a spool 104, a helical torsion spring 106 which has a constant spring force, a wire cable 108 having ends 110, a cable roller 112, a dowel 114 that forms the axle of the roller 112, and rivets 116 for attachment to crib side gate 28. One end 110 of wire cable 106 is permanently attached to spool 104 and wire cable 106 is wrapped around spool 104. One end of constant spring force spring 106 is also permanently attached to spool 104. The other end of the spring 106 is permanently attached to outer housing 102. The wire cable 108 exits housing 102 through an opening 118. Cable roller 112 is also located in opening 118. The cable 108 wraps around a portion of cable roller 112 as the cable 108 exits the housing 102 parallel to the floor, passes through track 76, and then turns upward approximately 90 degrees as it enters vertical frame member 34.

Figure 4:
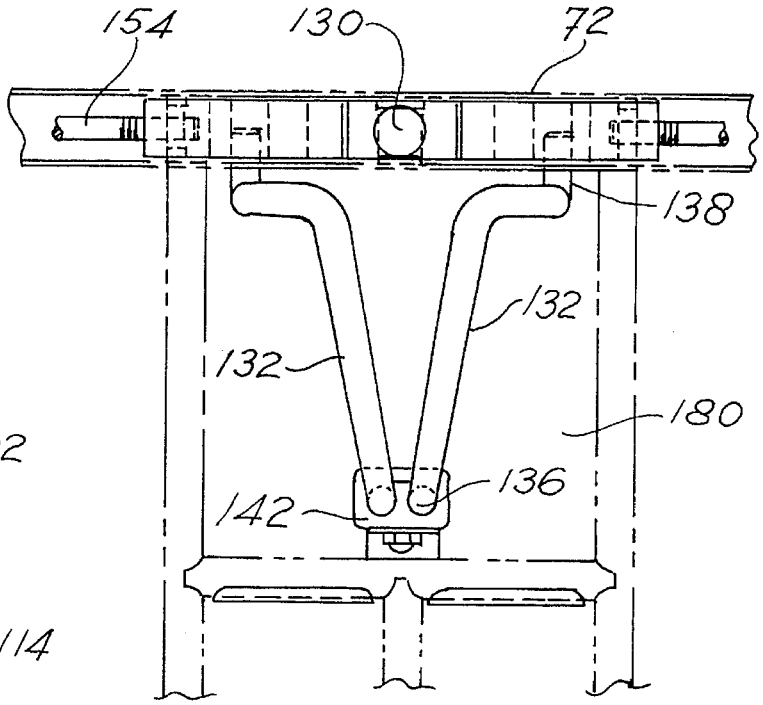
FIG. 4 is a front view of the release mechanism.
Figure 5:
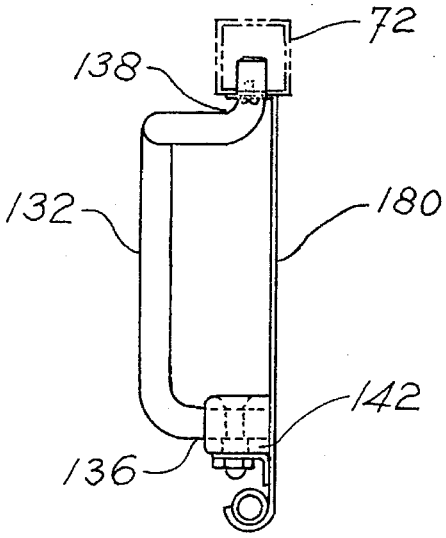
FIG. 5 is a side view of the release mechanism.
Figure 6:
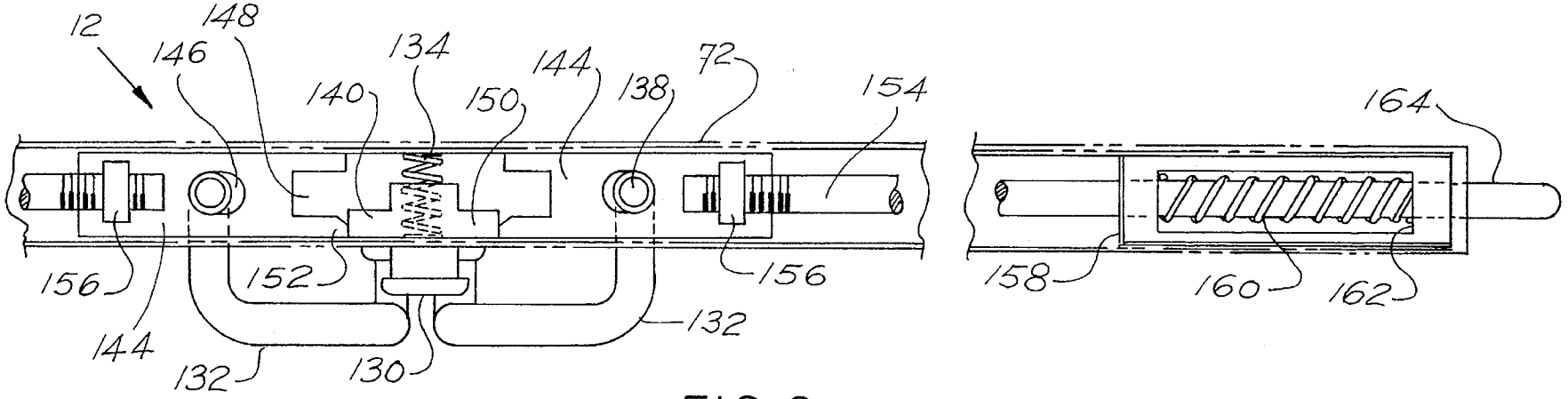
FIG. 6 is a cutaway top view of the hospital youth crib side gate including the release mechanism.

The extended portion of cable 108 runs parallel to either the head end frame 22 or foot end frame 24, depending upon which end of crib 20 spring powered reel 100 is located on and its free end 110 is fixedly attached to vertical member 34 of either head end frame 22 or foot end frame 24 within track 80. Push button latch mechanism 12 as shown in FIGS. 4, 5, and 6 requires a one-hand sequential compound motion before side gate 10 is released from its locked position and is free to slide up or down receiving track 80. The latch mechanism 12 is a dual sequential action device. Only one hand is necessary to operate the latch mechanism 12 which secures side gate 10 into one of three (3) locked positions.

Latch mechanism 12 includes a push button 130 and a release button 140 both biased in an extended position by push button spring 134. Lower ends 136 of a pair of handles 132 are pivotally located in handle retainer 142 as shown in FIG. 4. As shown best in FIG. 6, upper handle ends 138 fit into latch trigger handle openings 146 in latch trigger 144. Adjacent to each latch trigger opening 146 is a latch trigger slot 148. When push button 130 and release button 140 are in the spring biased or extended position, the tabs 150 of release button 140 rest against latch trigger stops 152. In this position, handles 132 cannot be brought together to release side gate 10. When push button 130 and release button 140 are fully depressed, release button tabs 50 move forward and into alignment with latch trigger slots 148. In this position, handles 132 can be brought together to release side gate 10 from its locked position.

Referring to FIG. 6, it can be seen that latch rods 154 are threadedly engaged into nuts 156 which are molded into latch triggers 144. Latch rods 154 pass through upper horizontal tubular frame member 72. Near each outer end of upper horizontal frame member 72 latch rods 154 pass through latch rod holders 158, latch rod holder springs 160, and retaining rings 162. Latch rod holder springs 160 rest against latch rod holders 158 which are fixedly attached to the interior of upper horizontal tubular frame member 72. The opposite ends of latch rod holder springs 160 rest against retaining rings 162 which are fixedly attached to latch rods 154. Thus, latch rod holder springs 160 bias latch rods 154 in an outward direction. Latch rod ends 164 protrude past the ends of upper horizontal tubular member 72 and fit into latch rod apertures 170 located in receiving tracks 80. In the preferred embodiment, three (3) apertures are provided at the following locations: side gate 10 fully raised, side gate 10 fully lowered, and at a midpoint between the raised and lowered positions.

A latch plate 180 is attached behind handles 132 so that the child patient cannot reach through side gate 10 in an effort to squeeze handles 132. Thus the latch mechanism 12 can only be operated from outside crib 20. This ensures that the child patient cannot release side gate 10.

The compound motion of latch mechanism 12 requires the operator to first push in and hold push button 30 and then squeeze handles 132 toward each other to the center line of the latch mechanism 12. Side gate 10 is now released and capable of sliding in tracks 80. Once one of its predetermined positions has been selected, side gate 10 can be relocked into the desired position by simply releasing handles 132. Side gate 10 is securely locked when push button 130 is fully extended by spring 134.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A counterbalanced side gate for a hospital youth crib having a crib frame, the side gate comprising:

a gate frame having an upper horizontal member parallel to a lower horizontal member and at least two vertical members connected between the upper and lower members;

at least one spring power reel attached to the gate frame;

the spring powered reel having a spring powered cable having an end;

the cable end attached to the crib frame;

a pair of handles having upper ends and lower ends, the lower ends being pivotally mounted to a handle retainer and each upper end being pivotally mounted to a latch trigger;

a push button and a release button located within the upper horizontal member and biased in an outward position by a push button spring;

each latch trigger located adjacent to the release button and having a latch trigger slot for receiving the release button when the push button is in a spring biased position;

a latch rod connected to each latch trigger, each latch rod extending axially outward through the upper horizontal member and having a latch rod end extending through the horizontal member aperture formed within each end of the upper horizontal member;

each latch rod end engaging with a latch rod aperture formed within the crib frame.

2. An improved hospital youth crib having a frame and a moveable side gate, wherein the improvement comprises:

a pair of spring power reels attached to the moveable side gate;

each spring power reel having a spring powered cable with a constant force exerted thereon;

each cable having an end;

the end of each cable attached to the crib frame;

the improved hospital youth crib further including a latch mechanism comprising:

a pair of handles having upper ends and lower ends, the lower ends being pivotally mounted to a handle retainer and each upper end being pivotally mounted to a latch trigger;

a push button and a release button located within the upper horizontal member and biased in an outward position by a push button spring;

each latch trigger located adjacent to the release button and having a latch trigger slot for receiving the release button when the push button is in a spring biased position;

a latch rod connected to each latch trigger, each latch rod extending axially outward through the upper horizontal member and having a latch rod end extending through a horizontal member aperture formed within each end of the upper horizontal member;

each latch rod end engaging with a latch rod aperture formed within the crib frame.

3. A method for counterbalancing a hospital youth crib side gate moveable within a side gate track, the side gate including:

a gate frame having an upper horizontal member parallel to a lower horizontal member and at least two vertical members connected between the upper and lower members;

at least one spring power reel attached to the gate frame below the lower member;

the spring powered reel having a spring powered cable having an end;

the cable end attached to the crib frame;

a pair of handles having upper ends and lower ends, the lower ends being pivotally mounted to a handle retainer and each upper end being pivotally mounted to a latch trigger;

a push button and a release button located within the upper horizontal member and biased in an outward position by a push button spring;

each latch trigger located adjacent to the release button and having a latch trigger slot for receiving the release button when the push button is in a spring biased position;

a latch rod connected to each latch trigger, each latch rod extending axially outward through the upper horizontal member and having a latch rod end extending through the horizontal member aperture formed within each end of the upper horizontal member;

each latch rod end engaging with a latch rod aperture formed within the crib frame, the method comprising the steps of:

attaching a pair of spring power reels having constant force cables to the side gate frame;

routing the constant force cables into the side gate track;

attaching the constant force cables to a mid point in the side gate track.

* * * * *